United States Patent [19]

Panning

[11] Patent Number: 4,778,114

[45] Date of Patent: Oct. 18, 1988

[54] SHREDDING APPARATUS

[75] Inventor: Martin H. Panning, Thiensville, Wis.

[73] Assignee: Blower Application Company, Germantown, Wis.

[21] Appl. No.: 36,974

[22] Filed: Apr. 10, 1987

[51] Int. Cl.[4] ..... B02C 25/00

[52] U.S. Cl. ..... 241/37; 241/166; 241/189 R; 241/241

[58] Field of Search ..... 241/293, 166, 294, 167, 241/295, 37, 239, 240, 241, 235, 236, 189 R, 34, 33, 32, 37, 285 R, 285 B, 243, 190, 242

[56] References Cited

U.S. PATENT DOCUMENTS

| | | | |
|---|---|---|---|
| 3,685,437 | 8/1972 | Panning . | |
| 3,724,766 | 4/1973 | Bosland | 241/100 |
| 3,754,498 | 8/1973 | Gil . | |
| 3,797,765 | 3/1974 | Samuels | 241/236 |
| 3,815,521 | 6/1974 | Panning . | |
| 3,882,770 | 5/1975 | Bleasdale . | |
| 4,166,030 | 8/1979 | Lewis . | |
| 4,172,400 | 10/1979 | Bierley . | |
| 4,223,844 | 9/1980 | Maillet | 241/33 |
| 4,330,092 | 5/1982 | Roman | 241/232 |
| 4,385,732 | 5/1983 | Williams | 241/236 |
| 4,562,971 | 1/1986 | Schwelling | 241/236 |
| 4,586,659 | 5/1986 | Easter | 241/24 |
| 4,603,816 | 8/1986 | Panning | 241/266 |

FOREIGN PATENT DOCUMENTS

| | | | |
|---|---|---|---|
| 791927 | 10/1935 | France | 241/239 |

*Primary Examiner*—Mark Rosenbaum
*Attorney, Agent, or Firm*—Willis B. Swartwout, III

[57] ABSTRACT

Improved shredding machine shredding mechanism having elongated wall and gate structure defining a chamber. The chamber walls have margins defining a material entryway at one common end and margins defining a material discharge aperture at the remote end of the chamber from the entryway. An electrically driven rotatable shredder journaled in the wall structure intermediate the entryway and discharge aperture. The gate pivotally mounted externally of the chamber for movement within the chamber at the entryway and extending from a point adjacent to one of the walls divergingly relative to the wall and terminating remote from the pivotal mounting and from the wall defining a progressively constricting chamber as to area of the chamber in latitudinal cross-sectional dimension from entryway to discharge aperture in a selected position of the gate. Electronic sensing means for the motor for rotating the shredder to sense resistance increases to the rotation of the shredder and coupled with hydraulic rams interconnecting the gate and the machine for pivoting the gate from the selected position to a plurality of additional positions progressively increasing the cross-sectional dimension of the chamber thereby increasing the volume thereof. In the selected position the gate assists in guiding material through the chamber. The gate has a plurality of combs for cleaning out between the shredding teeth when the gate is in the selected position.

13 Claims, 7 Drawing Sheets

SHREDDING APPARATUS

BACKGROUND OF THE INVENTION

The field of the present invention is shredding machinery, particularly shredding machinery for converting paper, cardboard and other materials into a shredded form. While the structure disclosed and described hereinafter is primarily concerned with paper products and the like, similar structure of appropriate strength materials could be used for shredding metal or similar materials.

In previous U.S. Pat. Nos. 3,685,437 and 2,894,697, machinery is disclosed for the shredding of paper products and the like which is similar to that which is envisioned for use in connection with a shredder as hereinafter disclosed. In such a system, waste paper products are moved by a plurality of upwardly inclined successively overlapping conveyors each succeeding conveyor operating at a higher rate of speed than the one preceding it so as to cause the waste paper to be spacially dispersed in a longitudinal axial direction relative to the conveyor surface.

Although substantial spacial dispersion of waste paper products is accomplished in this fashion, the products tend to reaccumulate in the shredder to some extent and this is especially true when glops or wads of such products get conveyed into the shredder. The greater the potential exposure of the waste paper products to moisture becomes as the result of acquiring, storing and transporting it to the shredder, the more likely it is that glops or wads will form. The result may be that the shredder forcibly slows or jams and the shredding apparatus which includes electromechanically rotated shredding structure is inhibited in or prevented from operating. Several serious results can result from this phenomenon. First, resistance can build up in the electric motor driving the apparatus or in the control system for the motor or both and if safety shut offs are not installed or if installed are not quickly functional, either the motor or controls or both may burn out. If safety shut off controls operate or the motor or controls burn out delays of the shredding operation result for potentially substantial periods of time. Second, journal and bearing structure for one or more shafts involved in the operation of the structure may be severely damaged resulting in even longer periods of machine shut down time while repairs are made.

Since the shredded material is simply being baled for shipment to a center for reprocessing, it is not that critical that every glop or wad be that thoroughly shredded and some may even pass through the shredder virtually unscathed and still be included in the bale. One important reason for this is that the shredded material is often reprocessed into paper or cardboard by being dumped into vats where water and chemicals are added to further break the waste down in the reprocessing process.

It is desirable, therefore, to provide in structure of the character described, a shredder constructed and controlled to eliminate the problems above described.

SUMMARY OF THE INVENTION

The present invention is an improved shredding machine for waste products which includes a waste material receiving entryway and a discharge aperture and electro-mechanically driven shredding mechanism intermediate the entryway and discharge aperture for shredding waste products passing therethrough. The electro-mechanical mechanism includes control structure for sensing resistance increases resulting from slowing or jamming of the shredding structure and, which in response to the sensing, operates hydraulic ram means. The shredding mechanism includes wall and gate structure defining a chamber within which the waste material is shredded and the gate being a part of or disposed for pivital movement within and generally parallel to one wall and coupled to the hydraulic ram means. The gate, in an original selected position, constricts the chamber to assist in directing the flow of the waste material into shreddable relationship with shredding knives or teeth disposed on rotatable means journaled in the wall structure. The sensing mechanism operates to activate the ram means to reposition the gate to one of a plurality of alternate positions other than the originally selected position to increase the chamber volume and thereby enable glops or wads to be discharged from or drop by gravity and centrifugal force through the chamber in partially shredded or unshredded condition freeing the shredding mechanism from its jammed or slowed state to return to normal speed.

A general object, therefore, of the present invention is to provide in a device of the character above described, a shredding machine for waste products, including a plurality of shredder walls interconnected to define an elongated waste material shredding chamber having margins defining a waste material inlet at one end and margins defining a waste material discharge aperture at the end remote from the waste material inlet, a rotatable shredder structure journaled in walls of the machine for rotational movement within the chamber, a gate mounted for pivotal movement within the chamber disposed in spaced relationship to one wall to diverge from a point adjacent to the one wall to a point substantially spaced from the one wall in an originally selected position thereby constricting the latitudinal cross-sectional area of the chamber progressively from material inlet to material discharge aperture thus assisting to direct the flow of waste material from the inlet to the discharge over and about the rotatable shredder structure, the gate being pivotally movable to a plurality of alternate positions expanding the latitudinal cross-sectional area of the chamber and therefore its volume such that waste material may flow more freely therethrough.

Another object of the present invention is to provide in structure of the character above described a plurality of alternate gate positions which progressively increase the latitudinal cross-sectional area and thus the volume of the chamber.

Yet another object of the invention is to provide in structure of the character above described hydraulic ram means coupled to the gate and machine for pivotally moving the gate between the original selected position and the plurality of progressive alternate positions.

A further object of the present invention is to provide in structure of the character above described electronic controls for operating the machine, including means for sensing increase of resistance or voltage to the operation of the rotatable shredder structure, and in response to the increase, activating the hydraulic ram means to pivot the gate from the original selected position to one of the plurality of progressive alternate positions.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
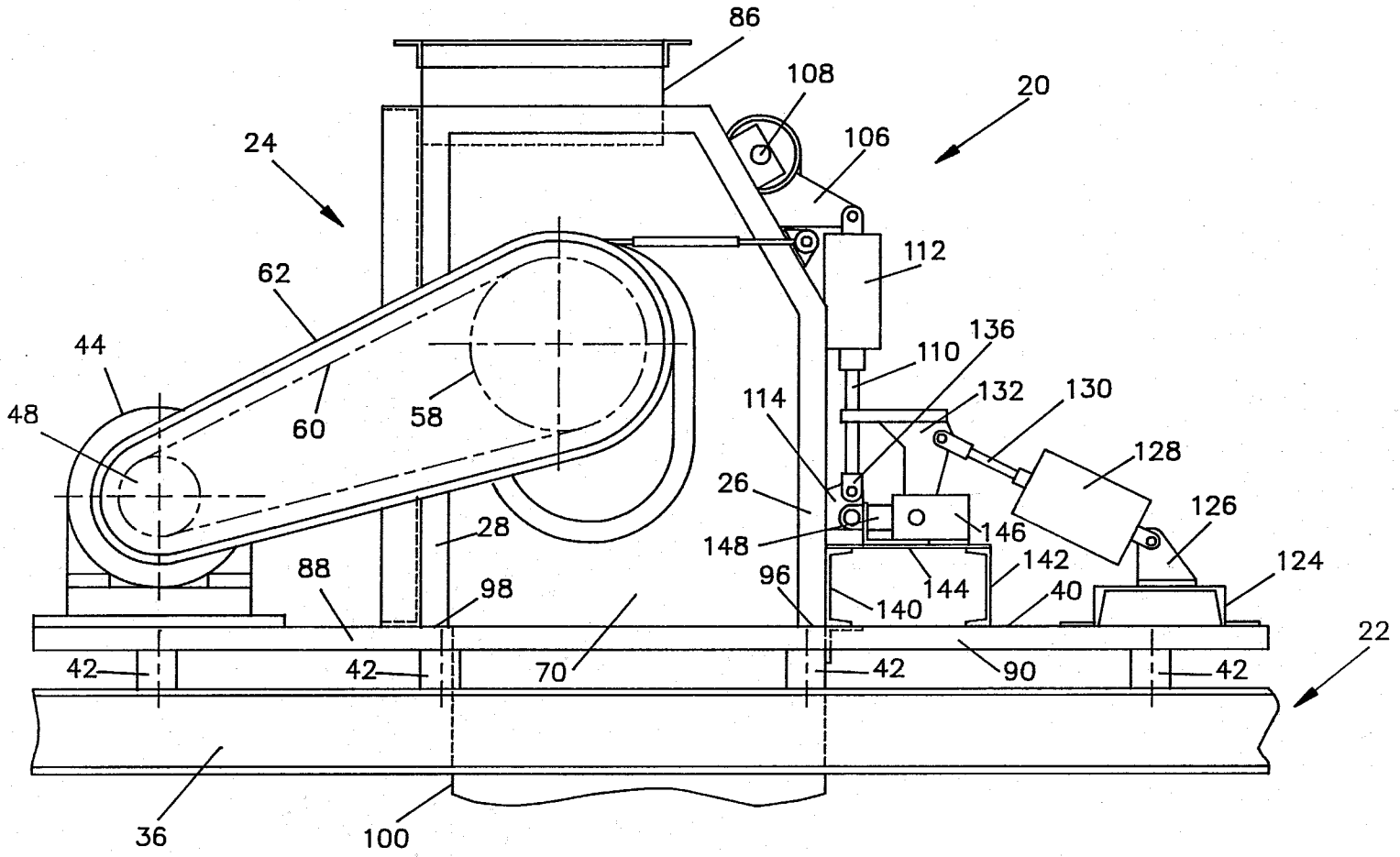
FIG. 1 is a side elevational view of a shredding machine embodying the present invention.

Referring now to the drawings, and more particularly to FIG. 1, a shredding machine is shown generally identified by the numeral 20. Machine 20 includes a base generally identified by the numeral 22 and a superstructure generally identified by the numeral 24 affixed to the base 22.

Also mounted on base 22 is an electric motor 44 of the conventional heavy duty variety. Superstructure 24 includes four elongated spaced walls 26, 28, 30 and 32 suitably joined together at their side margins to form an elongated shredding machine chamber 34. The overall vertical length of walls 26, 28, 30 and 32 is the same. It is required to view FIGS. 2 and 3 of the drawings to see all of the sides 26, 28, 30 and 32.

Figure 2:
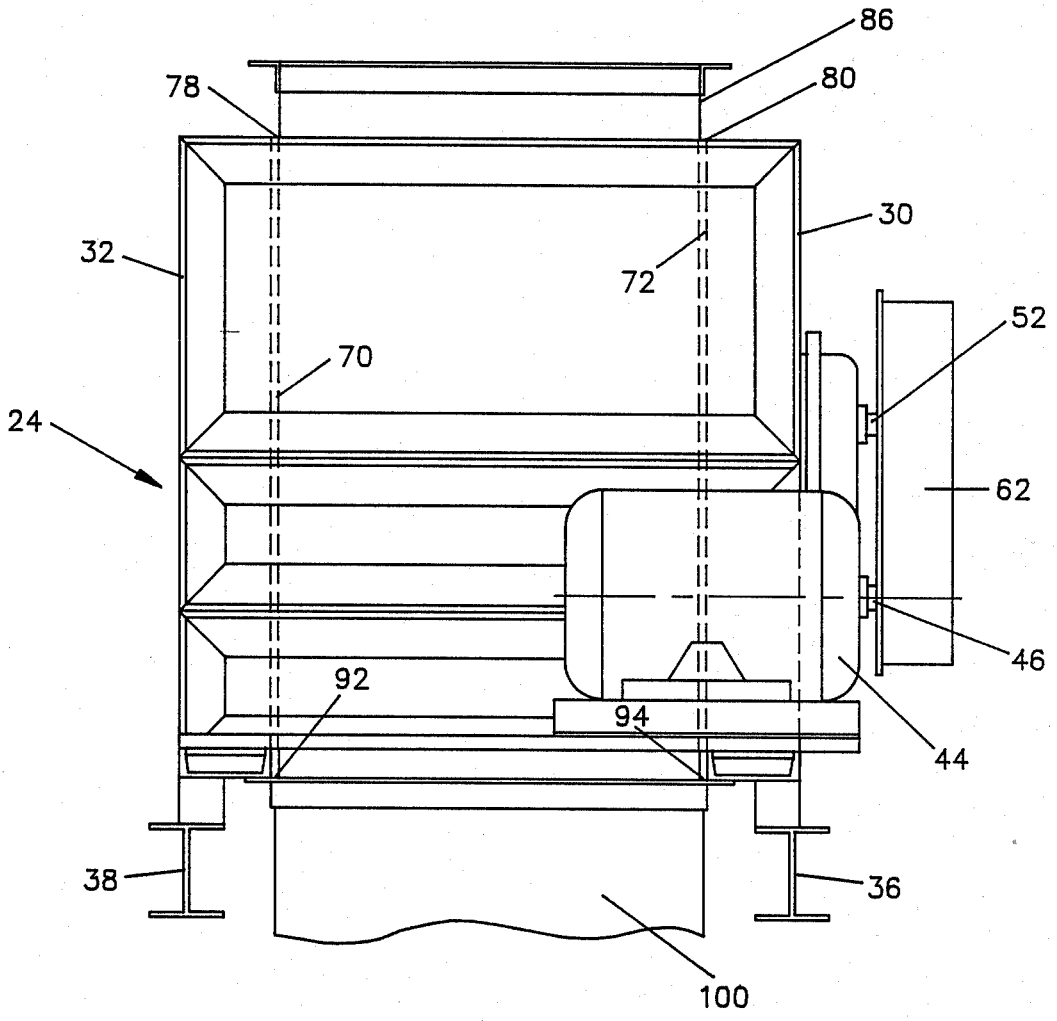
FIG. 2 is an end elevational view of the structure shown in FIG. 1 as viewed from the left.
Figure 3:
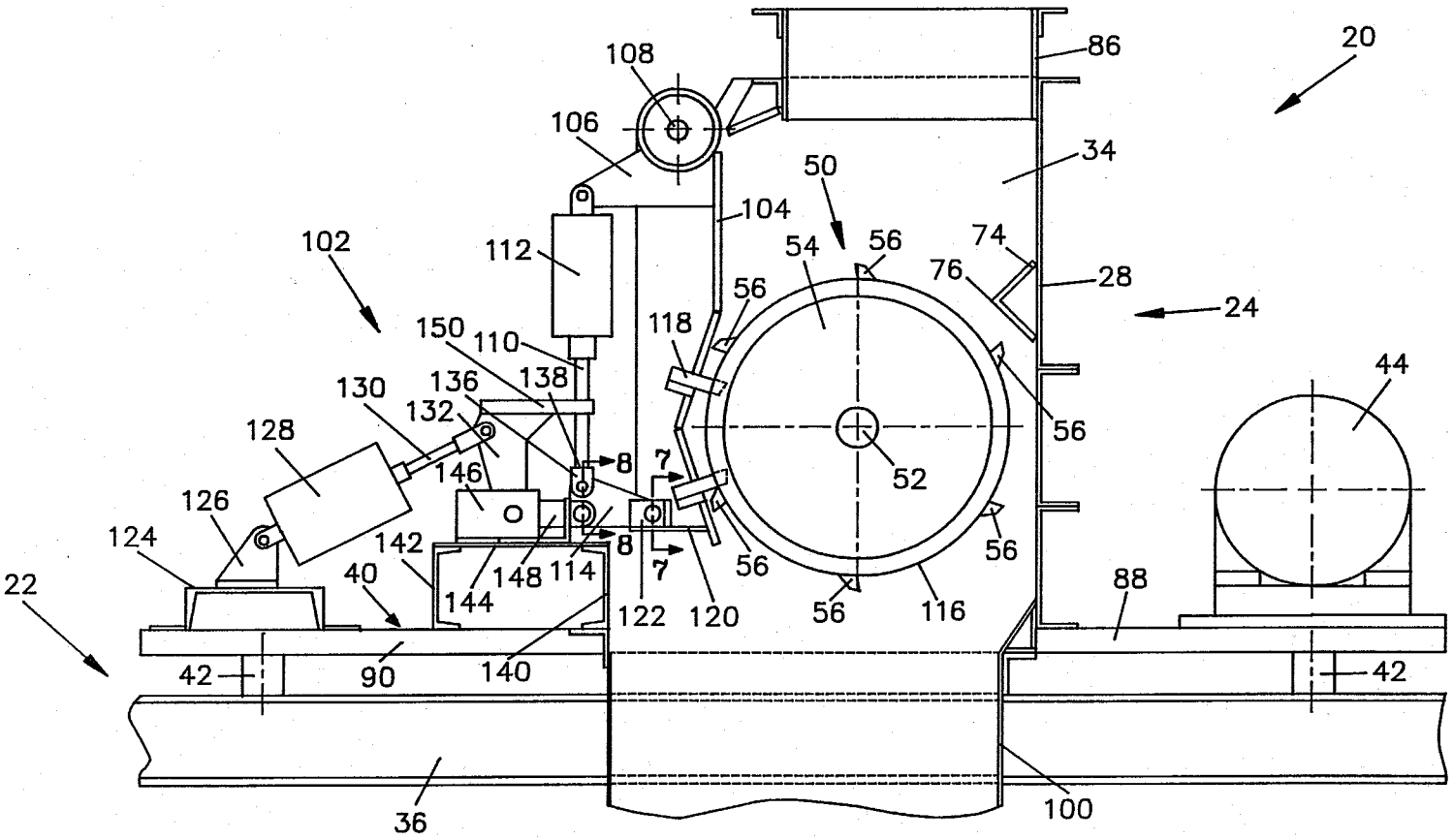
FIG. 3 is a view partly in side elevation and partly in vertical cross-section through side elevation of the structure shown in FIG. 1 from the opposite side relative to FIG. 1 and exposing internal machine structure required to explain the present invention.

Referring to FIGS. 1, 2 and 3 of the drawings, it can be readily seen that base 22 is comprised of a pair of horizontally spaced, parallel I-beams 36 and 38, to which a superstructure platform 40 consisting of several sections is joined in vertically spaced, parallel relationship by a plurality of spacer-joiners 42. Secured to one section of platform 40 is electric motor 44 having an output drive shaft 46. A pulley 48 is mounted on shaft 46 as desired in a conventional manner such as by a key and keyway (not shown). While either a pulley 48 or a gear may be used, a pulley is disclosed in the preferred embodiment.

Attention is again directed to FIGS. 1, 2 and 3 of the drawings but most specifically to FIG. 3 which discloses rotatable shredding means generally identified by the numeral 50.

Shredding means 50 includes an elongated rotor shaft 52 journaled in any suitable manner in walls 30 and 32. A rotor 54 is mounted in a fixed manner on shaft 52 to rotate therewith within chamber 34. Rotor 54 is provided with ripper teeth 56 spaced helically-longitudinally about the exterior of rotor 54 relative to the longitudinal centerline axis of rotor 54 and shaft 52. Shaft 52 extends beyond wall 30 terminating exteriorly of chamber 34 and is provided with a rotor shaft pulley 58 in the same vertical plane as pulley 48 such that the two may be interconnected by a V-belt 60. The pulley 58 may be mounted to shaft 52 in any conventional manner such as a key and keyway (not shown) to rotate with shaft 52. The entire structure including belt 60, pulley 48, pulley 58 and the ends of shafts 46 and 52 are enclosed for safety and appearance purposes within a belt and pulley housing 62.

It can now be easily shown that when electric power from a source (not shown) is supplied to motor 44, drive shaft 46 and drive pulley 48 will through belt 60, drive rotor shaft pulley 58 and shaft 52 thereby rotating rotor 54 within chamber 34. In the instant disclosure, this drive is in a counterclockwise direction as viewed in FIG. 3 of the drawings.

Reference to FIGS. 1, 2 and 3 of the drawings will disclose that elongated wall 28 consists of upper channel section 64, middle channel section 66 and lower channel section 68 suitably secured together in vertically stacked relationship by any suitable removable fastener (not shown). This is to allow removal of middle channel section 66 which acts as an access window or door to chamber 34.

Continuing reference to FIGS. 1, 2 and 3 will show that chamber 34 has a pair of vertically elongated chamber restricting inner side walls spaced axially relative to shaft 52 and numbered 70 and 72 respectively. Chamber restricting walls 70 and 72 are provided with apertures (not shown) for shaft 52 to pass through in rotatable relationship thereto. Walls 70 and 72 are bolted in place in the preferred construction but could be fastened in any other suitable manner. Walls 70 and 72 extend laterally from elongated wall 26 to elongated wall 28.

Note that an angle baffle 74 is mounted on the interior surface of upper channel section 28 and extends laterally from wall 70 to 72. Baffle 74 is positioned to have its angle extremity or apex 76 slightly greater in radial distance from shaft 52 than the radially outward most extremity relative to shaft 52 of teeth 56. Note that chamber restricting inner side walls 70 and 72 and angle baffle 74 are three-fourths of structure to channel waste material entering chamber 34 over rotatable shredding means 50. The upper margin 78 of inner wall 70 and upper margin 80 of inner wall 72 together with the upper extremity margin 82 of elongated wall 28 and the upper extremity margin 84 of wall 26 define a generally rectangular aperture for receiving in telescoping relationship therein entryway chute 86. Chute 86 is provided with a circumscribing lip flange 88 to overlay the margins 78 and 80 and upper extremity margins 84 and 86 of walls 28 and 26 respectively. To prevent vibration rattling a gasket (not shown) may be inserted between the underside of lip flange 88 and the margins 78, 80, 84 and 86.

Platform 40 is disclosed in FIG. 3 as though it were a unitized platform, however, it is actually comprised of a motor platform section 88 and a ripper gate platform section 90.

As can be seen from FIGS. 1, 2 and 3 of the drawings, lower inner side wall margins 92 and 94 of walls 70 and 72 together with lower side wall margin 96 of side wall 26 and lower side wall margin 98 of side wall 28 cooperate to form a discharge aperture at the bottom of chamber 34 into which a discharge chute 100 is telescopingly inserted and fixedly mounted in any suitable fashion (not shown). This joinder could be either welding or through the use of conventional removable fasteners.

Referring now most particularly to FIGS. 1 and 3 of the drawings vertically elongated gate means are disclosed and generally identified by the numeral 102. Gate means 102 include a laterally, arcuately pivotable ripper gate 104 fixedly mounted at one end to a gate link 106 on one side at the upper extremity of chamber 34. Gate link 106 is fixedly mounted on ripper gate pivot shaft 108 for lateral arcuate pivoting of gate 104 within chamber 34, said pivoting action structure disposed externally of chamber 34 which in turn is mounted for rotational movement to inner walls 70 and 72 adjacent their respective upper margins 78 and 80.

The end of gate link 106 remote from gate 104 is pivotally connected to an end connector of first ram 112. A first ram shaft 110 protrudes axially from the end of first ram 112 remote from gate link 106. The end of ram shaft 110 remote from gate link 106 is pivotally connected to pivot link 114. Ram 112 is in the preferred embodiment a pneumatic ram but could be any form of hydraulic ram. Ram 112 is portrayed in FIGS. 1 and 3 in its so-called normal position when it is not activated. The ram is connected to a source of air (fluid) under pressure (not shown) but schematically illustrated in FIG. 10 of the drawings and is provided with an electrically operated solenoid valve of a well known variety (not shown) but schematically illustrated in FIG. 10 of the drawings easily available on the market. When activated, the solenoid ports air (fluid) under pressure to the lower end of ram 112 driving the piston upwardly as viewed in the drawing. When the solenoid is not activated, the ram shaft 110 returns to its normal position as shown in the drawings urged by spring or other suitable biasing means in the upper end of ram 112 and gravity porting the air to atmosphere.

The end of ripper gate 104 remote from gate link 106 is generally V-shaped in vertical cross section as viewed in FIG. 3 of the drawing. The interior angle of the V-shaped end of gate 104 faces toward rotor 54 and is sufficiently obtuse an angle so as to generally circumscribe an arcuate portion of shredding means 50 radially spaced from shaft 52 a sufficient distance so as to clear ripper teeth 56.

Rotor 54 is provided with a plurality of circular parallel axially spaced ripper teeth mounting rings 116 protruding radially from the exterior of rotor 54, thereby defining intervening grooves between the rings 116.

Each leg of the V-shaped end of ripper gate 104 is provided with a plurality of combs 118 fixedly mounted to the gate 104 and protruding therefrom toward rotor 54. Combs 118 are axially spaced relative to shaft 52 such that they protrude into the grooves defined by rings 116 so that when material in the process of shredding lodges in the grooves defined by rings 116 the combs clean out the lodged material so that it falls via gravity and centrifugal force toward the discharge aperture and discharge chute 100. The lowermost extremity of gate 104 is provided with a pivot block flange 120 protruding toward side wall 26 to which is fixedly mounted a first pivot block 122. The end of pivot link 114 remote from the coupling of first ram shaft 110 and link 114 is pivotally connected to first pivot block 122 as is clearly shown in FIG. 7 of the drawings. Wall 26 is provided with a suitable aperture to permit link 114 to move arcuately therethrough as will be hereinafter described.

Referring again to FIGS. 1 and 3 of the drawings, additional structure forming a part of gate means 122 will be hereinafter described. Details of that structure will be shown in FIGS. 4, 5 and 8 to assist in understanding of the manner in which the structure functions.

At the extreme right of FIG. 1 and the extreme left of FIG. 3 of the drawings a channel mount 124 is shown fixedly mounted to ripper gate platform section 90 upon which a ram mounting bracket 126 is fixedly mounted. A second ram 128 having a second ram shaft 130 extending outwardly axially from one end is mounted to have bracket mounting tab 134 at one end of ram 128 fixedly connected to bracket 126 and the end of shaft 130 pivotally connected to a bell crank detent link 132 intermediate the extremities thereof.

At the end of first ram shaft 110 remote from ram 112 a pivot link connector 136 joins shaft 110 to pivot link 114 in a pivotal fashion and is greater in overall horizontal dimension therethrough than shaft 110 so that a shoulder 138 is formed for purposes that hereinafter will become obvious.

Intermediate channel mount 124 and superstructure 24 on platform section 90 a first channel member 140 and a second channel member 142 are fixedly mounted in spaced parallel relationship the space being bridged by a block plate 144 the undersurface of which is fixed to the members 140 and 142 and the upper surface of which supports a second pivot block 144. Note that the members 140 and 142 are set in place on one leg thereof such that plate 144 is in a plane spaced parallel and above the plane of the upper surface of channel mount 124 but horizontally offset from channel mount 124.

A second pivot block 146 is fixed to the top surface of plate 144. Second block pivot link 148 is pivotally connected at one end to second pivot block 146 such that the pivotal connection of second block pivot link 148 to pivot link 114 is spaced and parallel to but directly below the connection of pivot link connector 136 with pivot link 114, the longitudinal axis of the two said connections lying in the same vertical plane as is shown in FIG. 8 of the drawings.

Along the uppermost edge of bell crank detent link 132 is a pivot link connector stop 150 which is bifurcated to slidably receive and allow vertical axial movement of shaft 110. However, shaft 110 can only move axially upwardly until pivot link connector shoulder 138 is stopped by the lower surface of the bifurcated portion of pivot link connector stop 150. The extremity of bell crank detent link furthest remote from the bifurcated end of pivot link connector stop 150 is pivotally connected to second pivot block 146 separately from second pivot block link 148.

Figure 4:
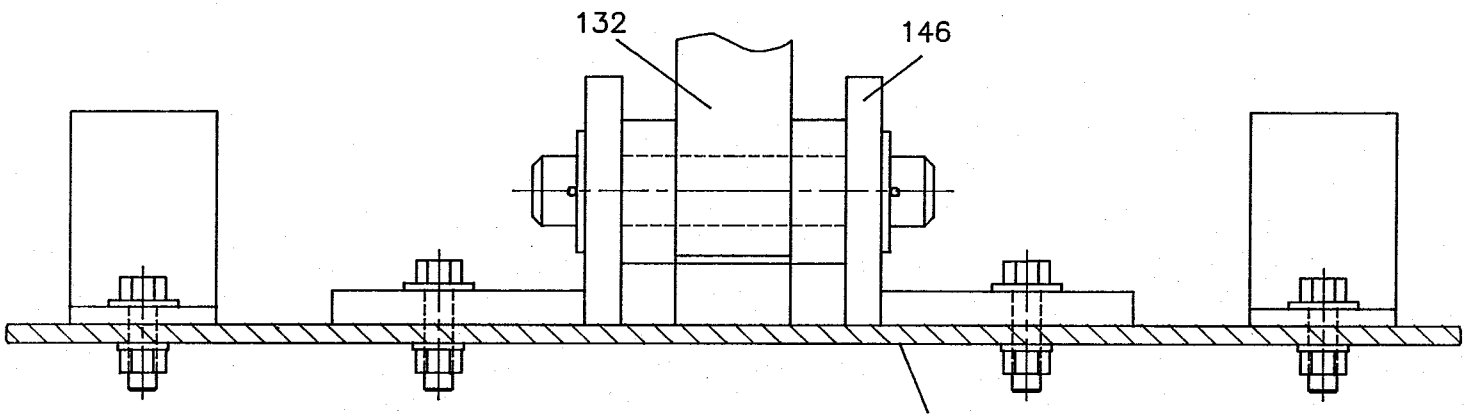
FIG. 4 is an end elevation of ram mounting structure at the left of FIG. 3, with one piece shown in cross section.
Figure 6:
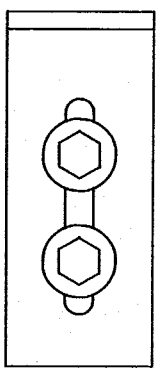
FIG. 6 is a partial top plan of a portion of the structure shown in FIG. 4.
Figure 5:
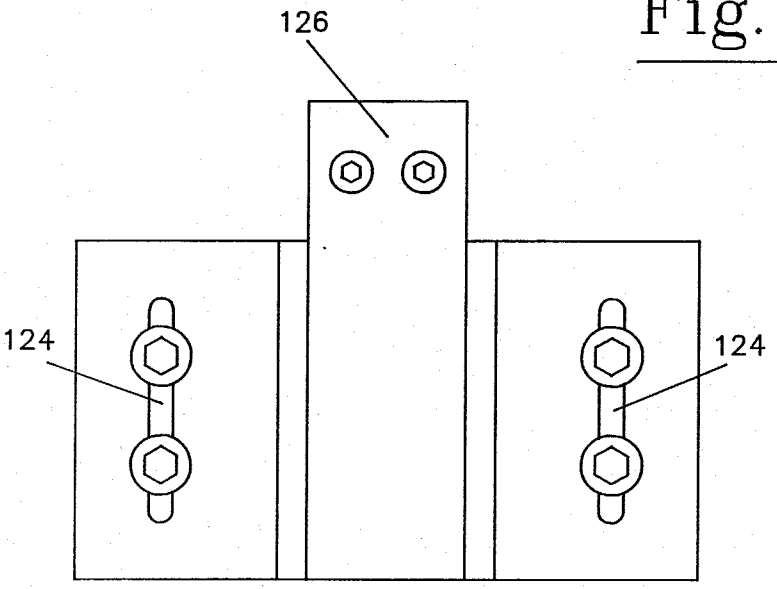
FIG. 5 is a top plan view of a portion of the structure shown at the extreme left of FIG. 3.

FIGS. 4, 5 and 6 show various slotted slidable mounting means not novel and of general knowledge to permit adjustment in the mounting of the structure described to prevent binding of the shafts 110 and 130 and the various linkages.

Figure 7:
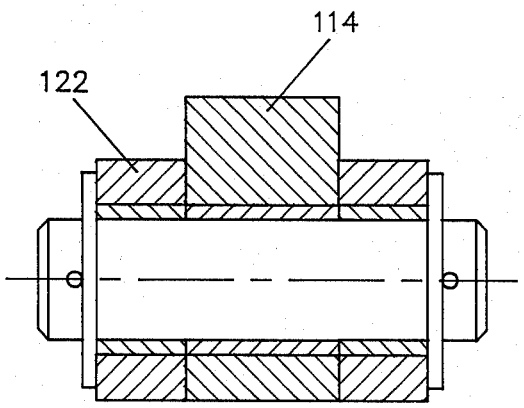
FIG. 7 is a vertical cross-section through a portion of structure shown in FIG. 3, taken along line 7—7 of FIG. 3 looking in the direction of the arrows.
Figure 8:
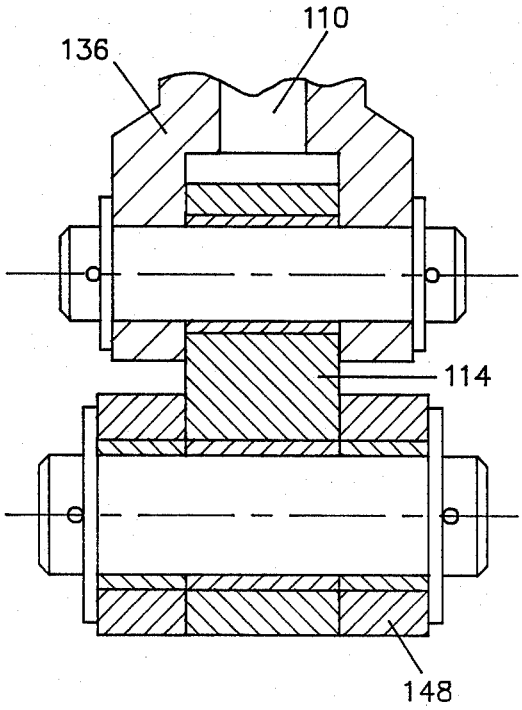
FIG. 8 is a vertical cross-section through a portion of structure shown in FIG. 3, taken along line 8—8 of FIG. 3 looking in the direction of the arrows.

Similarly, FIGS. 7 and 8 show details of the pivot connections including bearing structure, pivot pins and pin retaining rings to aid in understanding of the pivotal connections, however, pivot connections herein described are well known in the art.

Figure 9:
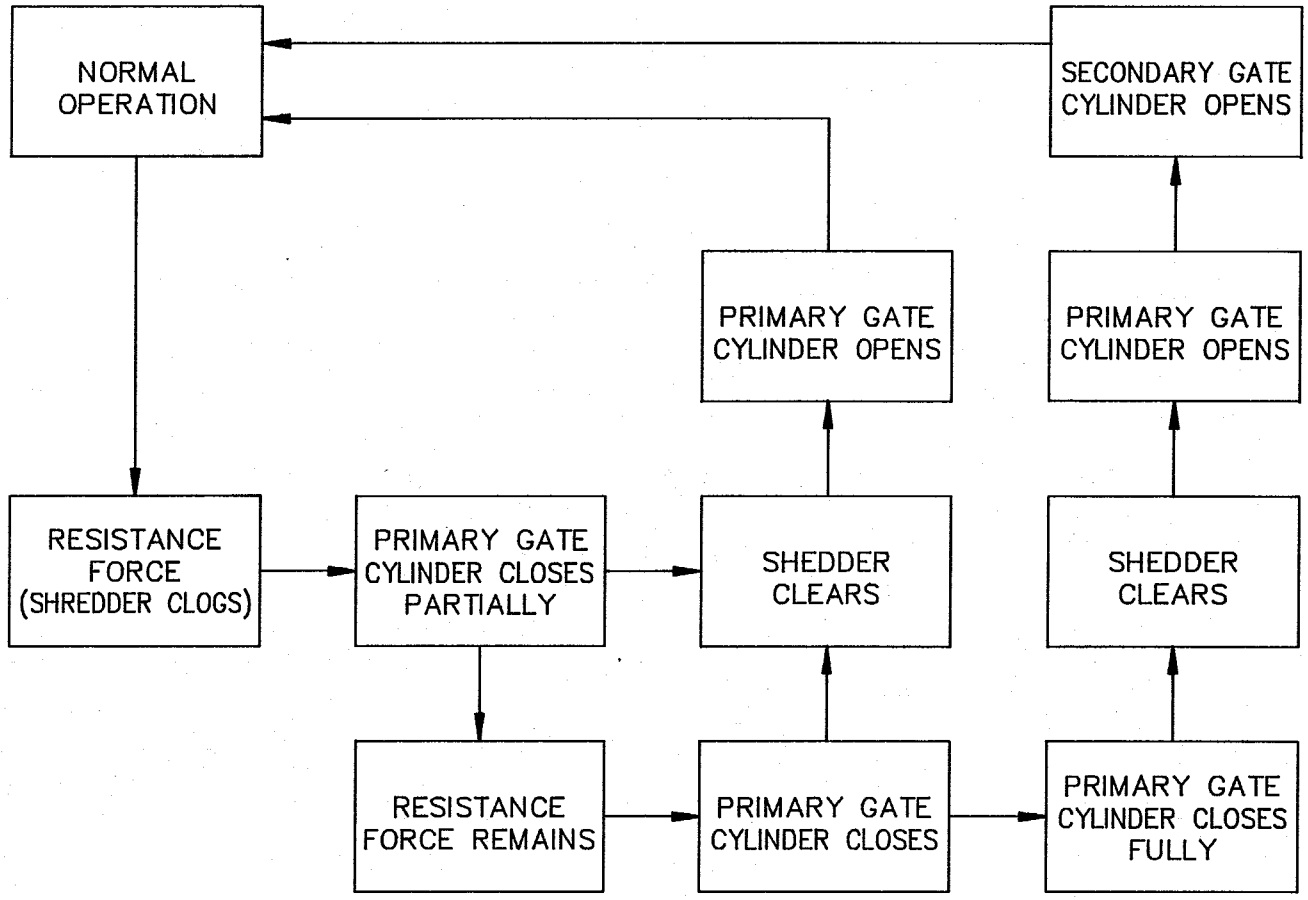
FIG. 9 is a flow chart to aid in explanation of the flow of the operation of the novel concept of the present invention.
Figure 10:
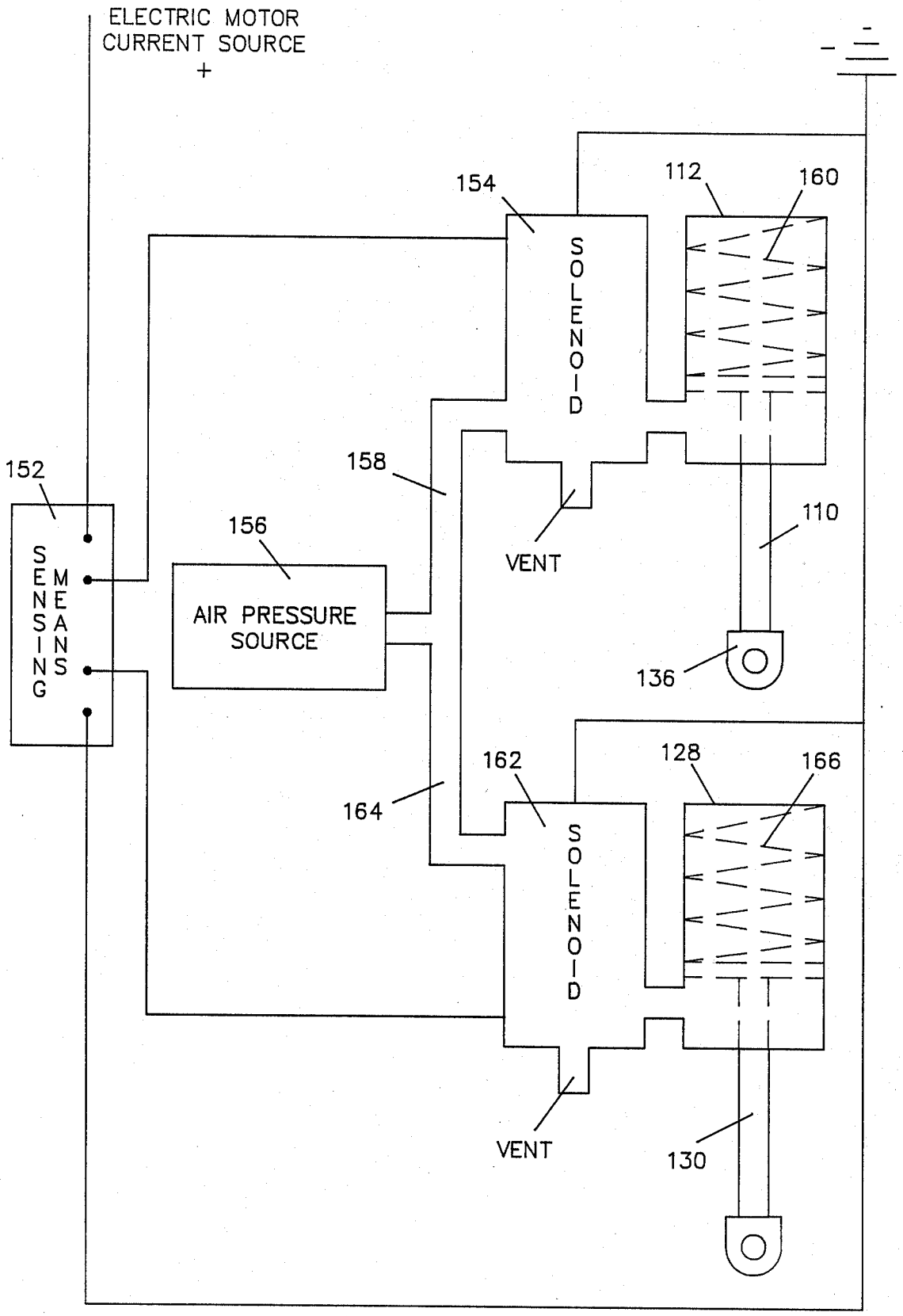
FIG. 10 is a schematic representation of electronic and pneumatic structure included in the novel concept of the presnt invention to aid in explanation of the machine operations.

Referring now most specifically to FIGS. 9 and 10 of the drawings when the shredding machinery is in operation a flow of waste material is being received into entryway chute 86 and falls by gravitation force into chamber 34 defined by chamber walls 70 and 72, ripper gate 104 and the inside of wall 28. Such waste material is further guided or directed by angle baffle 74. Thus, it can be seen that the material is guided over the rotating shredding means 50 where it is shredded by ripper teeth 56 after which it is directed by gravity and centrifugal force to fall through discharge chute 100 after which it will be baled or otherwise processed in operations which form no part of the present invention.

From time to time, the waste materials such as paper, corrugated board and other absorbent products have taken on sufficient moisture to form glops or wads of waste material causing a build-up and back-up of waste products in chamber 34 which ultimately severely impede the rotational movement of shredding means 50, particularly rotor 54 and shaft 52. Such action could cause belt 60 to burn, cause bearing wear of failure at the locations that shaft 52 is rotatably journaled and could cause burn out of various points of the electric and electronic structure which provides the operating power of the machine and at the same time meshes the machine operations in a sequential fashion with the operations of conveyors, compactors, bale making structure and other satellite equipment. It is undesirable and uneconomical to shut the equipment down to clear it and since the presence of some partially shredded or unshredded glops or wads in the shredded material may be easily accommodated this invention describes an alternate method of dealing with the situation.

In the electric circuit for operation of the motor 44, there has been installed a sensing means 152 which may be a resistor, capacitor, or other means for sensing resistance or voltage increases from blockages which slow the normal rotational movement of shaft 52 and rotor 54.

Sensing means 152 activates a first solenoid valve 154 which is operably coupled to a source of pneumatic pressure 156 by a fluid flow line 158. Solenoid 154 has a pneumatic connection to ram 112 which is normally blocked by a solenoid operated valve. As air under pressure is delivered to ram 112 by solenoid valve 154, the piston is biased causing shaft 110 to move upwardly along its longitudinal centerline axis until shoulder 138 of pivot link connector 136 engages the under surface of the bifurcated extremity of pivot link connection stop 150. Thus, links 148 and 114 pivot relative to first pivot block 122 and second pivot block 148 causing ripper gate 104 to pivot arcuately away from rotor 54, teeth 56, rings 116 and shaft 52 allowing wads, glops and accumulated materials to pass easily over and around rotor 54 and drop by gravity into discharge chute 100. At the same time, the rotational speed of rotor 54 will usually return to normal or increase toward normal adding centrifugal force to the discharge of the wads or glops. If the sensing means senses a return to normal operational conditions, solenoid valve 154 will return to its original position blocking air under pressure to ram 112 and venting ram 112 to atmosphere. A biasing means such as a spring 160 will then axially return shaft 110 to its original positioning reversing the pivot process previously described.

Should sensing means 152 sense a continuation of resistance increases or voltage increases, a second solenoid valve 162 will be operated to port air under pressure through second fluid flow line 164 and the valve part of second solenoid valve 162 to ram 128 with which it is coupled to deliver air under pressure. This will cause shaft 130 to move along its longitudinal centerline axis toward ram 128 pulling bell crank detent link to pivot on second pivot block 146 withdrawing the bifurcated extremity of pivot link connector stop 150 from engagement with shoulder 138 of link 136. Removal of stop 150 in this fashion permits shaft 110 to move further axially upwardly arcuately moving ripper gate 104 increasing the volume of chamber 34 that rotor 54 and shaft 52 can virtually spin freely until gravity and centrifugal force clear the chamber.

When the resistance or voltage drops and both solenoid valves 154 and 162 are deactivated blocking air pressure to both rams and venting the air pressure in the rams. Biasing means 160 in ram 112 and second biasing means 166 of ram 128 reverse the pivoting action of both sets of linkages restoring all structure to its starting position.

While the flow chart of FIG. 9 and schematic diagram of FIG. 10 are simplistic, they serve to show the manner in which the structure of the present invention operates to accomplish all of the objectives previously set forth herein.

I claim:

1. A shredding machine comprising:

(a) a machine base;

(b) a plurality of vertically equally elongated walls having varied geometric configurations in vertical plan view mounted on said base and interconnected to form a chamber, the walls having margins at one common end defining a restricted entryway relative to said chamber, and said walls having common margins at the other common end defining a discharge aperture;

(c) a shredder journaled for rotational movement in said walls within said chamber intermediate said entryway and said discharge aperture;

(d) means coupled to said base and said shredder for electro-mechanically rotating said shredder;

(e) an elongated gate pivotally mounted at one end of said elongated walls externally of said chamber for lateral arcuate pivotal movement within said chamber at the entryway;

(f) hydraulic ram means coupled to said base and to said pivotal mounting for said gate, said ram means holding said gate in an originally selected position diverging the gate to a position where the end of said gate remote from said pivotal mounting is remote from said one of said walls thereby defining a constricted chamber from said entryway to said discharge aperture; and (g) electronic sensing means coupled to said electromechanical means and said ram means for sensing resistance to the rotational operation of said shredder and pivoting said gate to a position reducing the constriction of said chamber until said resistance is eliminated, said ram means returning said gate to said originally selected position upon the elimination of said resistance.

2. The combination of structure as set forth in claim 1, wherein a plurality of shredder teeth are disbursed about the shredder in spaced axial and helical relationship to said shredder.

3. The combination of structure as set forth in claim 2, wherein said shredder is a cylindrical rotator fixedly mounted on an axis shaft, and a plurality of spaced parallel circular rings are affixed thereto for the purposes of mounting of said plurality of teeth and simultaneously defining grooves between the rings.

4. The structure as set forth in claim 3, wherein the elongated gate is provided with a plurality of spaced combs fixedly mounted to said gate remote from the pivotal mounting thereof and projecting toward the shredder cylinder a sufficient distance to fit into the grooves on said shredder cylinder between said spaced parallel rings.

5. The structure as set forth in claim 4, in further combination with a pair of inner spaced parallel walls spaced also from and parallel to opposing exterior walls and with one of the remaining exterior walls and elongated gate defining a restricted shredding chamber, the upper margins of the inner walls and the upper margins of the remaining two exterior walls defining the entryway to receive in telescoping engagement and entryway chute.

6. The structure as set forth in claim 5, in further combination with the lower margins of the inner walls and the lower margins of the remaining elongated exterior walls defining the margins of a discharge aperture for telescopingly receiving a discharge chute therein.

7. The structure as set forth in claim 6, wherein the machine base constitutes a pair of spaced parallel I-beams lying in the same horizontal plane joined by a plurality of platforms including at least a motor mounting platform section and a ripper gate mounting section in spaced relationship in the same horizontal plane and defining an aperture for the shredding machine to overlie.

8. The structure as set forth in claim 6, wherein the plurality of equally elongated walls includes two sets of spaced parallel elongated walls joined at their side margins to form a generally rectangular figure within which an additional set of inner spaced parallel walls of the elongated variety are joined to define a shredding chamber, which includes two spaced parallel exterior walls and two spaced parallel interior walls.

9. The structure as set forth in claim 6, wherein the shredder journaled for rotational movement in said walls includes an axle shaft lying in a horizontal plane and extending through said inner set of spaced parallel walls and journaled in the outer spaced parallel walls that are also spaced and parallel to the inner walls, said extension of said axle shaft through said inner walls permitting rotational movement, a generally cylindrical rotor fixedly mounted to said axle shaft, said shredder being provided with a series of spaced parallel ripper teeth mounting rings dispersed axially with respect to said axle shaft and cylinder to define a plurality of grooves in said cylinder, said rings being mounted to receive in fixed engagement shredder teeth dispersed on said rings about said cylinder in spaced, helical arrangement.

10. The structure as set forth in claim 9, wherein said means coupled to said base and to said shaft for rotating said shaft are electro-mechanical means and includes an electric motor having a rotatable shaft to which a pulley is mounted, which pulley lies in the same vertical plane with a pulley mounted on the axle shaft of the shredder cylinder the two pulleys being drivingly joined by a V-belt such that when electric power is supplied to said motor, the respective pulleys cause the axle shaft and shredder cylinder to rotate.

11. The structure as set forth in claim 6, wherein the hydraulic ram means consists of a first hydraulic ram coupled at one end to the pivotal mounting for the gate and at the other end to linkage mechanism coupled with the side of said gate remote from said shredder, for the purposes of holding said gate in a position to create a progressively diminishing cross-sectional dimension of the shredding chamber, said ram being connected to a source of air under pressure and a solenoid valve for selectively porting air under pressure to said ram or venting said ram to atmosphere whereby the ram may reposition the elongated gate to increase the horizontal cross-sectional dimension of said chamber, said hydraulic ram means also including a second hydraulic ram coupled to linkage providing a detent stop against which the shoulder of a coupling link mounted on the axially moveable shaft of the first ram will impinge to prohibit further axial movement of said first ram shaft, but coupled to a source of air under pressure and having a solenoid valve to port said air to said second ram or to vent it to atmosphere for retracting the detent stop by axially movement of the second hyraulic ram shaft thereby enabling the shaft of the first ram to move axially to a further extent further arcuately moving the ripper gate away from the shredder rotor and increasing the horizontal cross-sectional dimension of the shredding chamber.

12. The structure as set forth in claim 6, wherein the electronic sensing means includes an electric capacitor in the electric line for the electric motor which can sense increasing resistance to the rotational movement of the rotor and axle shaft causing the solenoids of the hydraulic ram means to operate responsively thereto by porting hydraulic fluid to said ram means or venting hydraulic fluid therefrom.

13. The structure as set forth in claim 6, wherein said elongated gate is externally pivotally coupled at one end to inner walls of the shredding chamber at the upper margin of said walls and extends downwardly therefrom in said chamber terminating in a V-shaped extremity remote from the pivotal mounting, the obtuse concave angle of the V-shaped portion of said elongated gate facing toward the shredder but spaced radially sufficiently further from said cylinder and axle shaft so as to allow the shredder teeth to clear the gate, the elongated gate extending between said inner walls adjacent one of the remaining outer walls and the other remaining outer elongated wall defining a shredding chamber of gradually decreasing horizontal cross-sectional dimension as said chamber proceeds from the entryway chute towards the discharge chute thereby forcing waste products coming through the entry chute to pass over and be shredded by the rotating shredder.

* * * * *